US011398338B2

(12) United States Patent
Inaba

(10) Patent No.: US 11,398,338 B2
(45) Date of Patent: Jul. 26, 2022

(54) REACTOR

(71) Applicants: AutoNetworks Technologies, Ltd., Mie (JP); Sumitomo Wiring Systems, Ltd., Mie (JP); Sumitomo Electric Industries, Ltd., Osaka (JP)

(72) Inventor: Kazuhiro Inaba, Mie (JP)

(73) Assignees: AutoNetworks Technologies, Ltd., Yokkaichi (JP); Summitomo Wiring Systems, Ltd., Yokkaichi (JP); Sumitomo Electric Industries, Ltd., Osaka (JP)

( * ) Notice: Subject to any disclaimer, the term of this patent is extended or adjusted under 35 U.S.C. 154(b) by 457 days.

(21) Appl. No.: 16/605,435

(22) PCT Filed: Apr. 4, 2018

(86) PCT No.: PCT/JP2018/014469
§ 371 (c)(1),
(2) Date: Oct. 15, 2019

(87) PCT Pub. No.: WO2018/193854
PCT Pub. Date: Oct. 25, 2018

(65) Prior Publication Data

US 2020/0126710 A1 Apr. 23, 2020

(30) Foreign Application Priority Data

Apr. 19, 2017 (JP) ..... JP2017-082703

(51) Int. Cl.
*H01F 27/25* (2006.01)
*H01F 27/255* (2006.01)

(52) U.S. Cl.
CPC ..... *H01F 27/255* (2013.01)

(58) Field of Classification Search
USPC ..... 336/233, 221
See application file for complete search history.

(56) References Cited

U.S. PATENT DOCUMENTS 6,668,444 B2 * 12/2003 Ngo ..... H01F 41/0226 336/212
2010/0328007 A1 * 12/2010 Witzani ..... H01F 3/14 336/178

(Continued)

FOREIGN PATENT DOCUMENTS

JP H5-057824 U 7/1993
JP 2000-353622 A 12/2000

(Continued)

OTHER PUBLICATIONS

International Search Report, Application No. PCT/JP2018/014469, dated Jun. 26, 2018. ISA/Japan Patent Office.

*Primary Examiner* — Shawki S Ismail
*Assistant Examiner* — Kazi S Hossain
(74) *Attorney, Agent, or Firm* — Honigman LLP

(57) ABSTRACT

A reactor includes a coil including wound portions; and a magnetic core that includes a set of core pieces that engage with each other and is arranged inside and outside of the wound portions. One core piece includes, at an end portion thereof, a recessed portion having a ring-shaped opening edge that is open toward the other core piece. The other core piece includes, at an end portion thereof, a protruding portion that is configured to be fit into the recessed portion. Both of the core pieces include, in the wound portions, ring-shaped contact portions that are provided along the opening edges and at which the core pieces come into surface contact with each other, and gap portions formed by non-contact regions in which the inner peripheral surfaces forming the recessed portions and the outer peripheral surfaces of the protruding portions are not in contact with each other.

11 Claims, 4 Drawing Sheets

(56) References Cited

U.S. PATENT DOCUMENTS

| | | | | |
|---|---|---|---|---|
| 2012/0098631 | A1* | 4/2012 | Ono | H01F 27/02 336/96 |
| 2018/0182522 | A1* | 6/2018 | Shirouzu | H01F 3/14 |

FOREIGN PATENT DOCUMENTS

| | | | |
|---|---|---|---|
| JP | 2007-128951 | A | 5/2007 |
| JP | 2011-253982 | A | 12/2011 |
| JP | 2015-126144 | A | 7/2015 |
| JP | 2017-027973 | A | 2/2017 |

* cited by examiner

3:3A, 3B

REACTOR

CROSS-REFERENCE TO RELATED APPLICATIONS

This application is the U.S. national stage of PCT/JP2018/014469 filed on Apr. 4, 2018, which claims priority of Japanese Patent Application No. JP 2017-082703 filed on Apr. 19, 2017, the contents of which are incorporated herein.

TECHNICAL FIELD

The present disclosure relates to a reactor.

BACKGROUND

A reactor is one component of a circuit that performs a voltage boosting operation and a voltage lowering operation. JP 2017-027973A discloses a reactor that includes: a coil including two wound portions arranged side by side; and a magnetic core formed by combining two U-shaped divided core pieces. The divided core pieces each include an outer core portion that is arranged outside of the wound portion and two inner core portions that protrude from the outer core portion. The two inner core portions are stored inside the wound portions. The inner core portions of the two divided core pieces are stored overlapping in one wound portion so as to be aligned in a direction intersecting the axial direction of the wound portion. The assembled divided core pieces include a gap between an end surface of an inner core portion included on one divided core piece, and the other divided core piece.

Regarding a reactor including a magnetic core formed by combining multiple core pieces as described above, it is desired that magnetic saturation is not likely to occur, and that the assembled state of the core pieces is easier to maintain.

The above-described magnetic core includes gaps between both divided core pieces, and therefore magnetic saturation is not likely to occur. Also, the above-described U-shaped divided core pieces are easily assembled by causing the inner core portions of the two divided core pieces to overlap, and thus excellent assembly workability is achieved. However, both divided core pieces that were assembled sometimes shift not only in the direction of moving away from each other, but also in the axial direction of the inner core portion, and therefore a reactor is desired in which the assembled state is more easily maintained.

In view of this, it is an object to provide a reactor in which magnetic saturation is not likely to occur, and the assembled state of the core pieces is easily maintained.

SUMMARY

A reactor of the present disclosure includes a coil including wound portions; and a magnetic core that includes a set of core pieces that engage with each other and is arranged inside and outside of the wound portions. One core piece in the set of core pieces includes, at an end portion thereof, a recessed portion having a ring-shaped opening edge that is open toward the other core piece, the other core piece includes, at an end portion thereof, a protruding portion that is configured to be fit into the recessed portion, and both of the core pieces include, in the wound portions, ring-shaped contact portions that are provided along the opening edges and at which the core pieces come into surface contact with each other, and gap portions that are formed by non-contact regions in which the inner peripheral surfaces forming the recessed portions and the outer peripheral surfaces of the protruding portions are not in contact with each other.

Advantageous Effects of the Present Disclosure

In the above-described reactor of the present disclosure, magnetic saturation is not likely to occur and the assembled state of the core pieces is easily maintained.

DETAILED DESCRIPTION OF PREFERRED EMBODIMENTS

Figure 1:
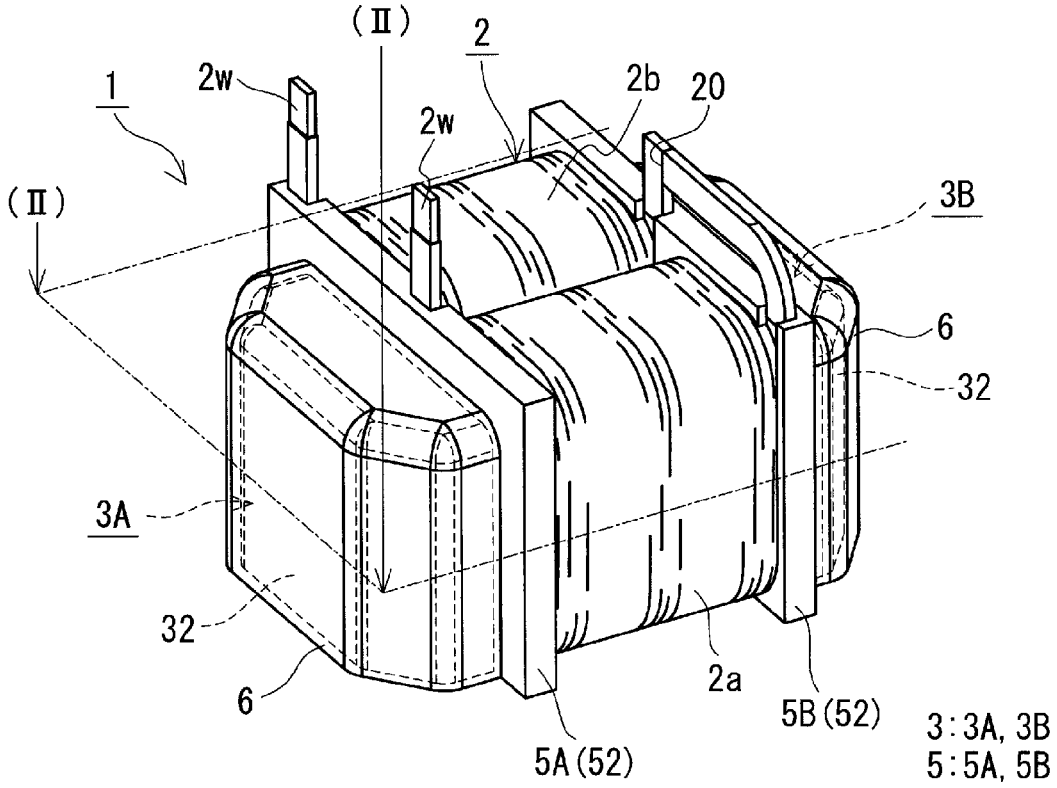
FIG. 1 is a schematic perspective view showing a reactor of Embodiment 1.

First, embodiments of the present disclosure will be listed and described.

A reactor according to an aspect of the present disclosure includes a coil including wound portions, and a magnetic core that includes a set of core pieces that engage with each other and is arranged inside and outside of the wound portions. One core piece in the set of core pieces includes, at an end portion thereof, a recessed portion having a ring-shaped opening edge that is open toward the other core piece, the other core piece includes, at an end portion thereof, a protruding portion that is configured to be fit into the recessed portion, and both of the core pieces include, in the wound portions, ring-shaped contact portions that are provided along the opening edges and at which the core pieces come into surface contact with each other, and gap portions that are formed by non-contact regions in which the inner peripheral surfaces forming the recessed portions and the outer peripheral surfaces of the protruding portions are not in contact with each other.

The ring-shaped contact portion includes part of the inner peripheral surface of the recessed portion and part of the outer peripheral surface of the protruding portion. Furthermore, the ring-shaped contact portion can include a frame-shaped end surface that is provided on one core piece and surrounds the opening edge of the recessed portion, and a frame-shaped surface that is provided on the other core piece and opposes the frame-shaped surface of the one core piece.

In the above-described reactor, it can be said that the recessed portion having the above-described ring-shaped opening edge is open only in one direction.

In this kind of state in which the recessed portion and the protruding portion are engaged with each other, the inner peripheral surface of the recessed portion is present so as to surround the entire periphery of the protruding portion, and can restrict the direction in which the two core pieces can move to one direction along the axial direction of the wound portion. Accordingly, although the above-described reactor includes multiple core pieces, the core pieces are easily assembled by engaging the recessed portion and the protruding portion with each other, and thus the assembly workability is excellent and it is easy to maintain the state in which the core pieces are assembled. Since the assembled state can be maintained, an adhesive agent that bonds the core pieces can be omitted, and because of this, the above-described reactor has excellent manufacturability.

Also, due to the above-described reactor including the ring-shaped contact portion, the space formed in the non-contact region in which the inner peripheral surface of the recessed portion and the outer peripheral surface of the protruding portion are not in contact with each other can be made into a substantially closed-off space. In the above-described reactor, the space is used as a gap portion (magnetic gap) and the gap portion is included in the wound portion, and therefore magnetic saturation is not likely to occur, even if the usage current becomes large. Also, low loss is easier to achieve compared to the case of providing the magnetic gap outside of the wound portion. Furthermore, since the gap portion is provided through engagement of the core pieces, the gap plate can be omitted and the number of components is smaller. For this reason as well, excellent assembly workability is achieved. In addition, the above-described reactor includes a magnetic path so as to surround the gap portion, including the above-described ring-shaped contact portion, and therefore it is expected that magnetic flux leakage from the gap portion will be reduced, and low loss is likely to be achieved. Note that the magnetic path surrounding the gap portion is relatively small since it is provided in a range in which the above-described space can be formed, and thus the above-described reactor is not likely to be subjected to magnetic saturation even if the reactor includes the contact portion.

Examples of the above-described reactor include an embodiment in which both of the core pieces are molded bodies of a composite material including a magnetic powder and a resin.

The above-described molded body of the composite material tends to have a relatively low permeability compared to a pressed powder molded body formed by press-molding a magnetic powder, and thus magnetic saturation is not likely to occur. In the above-described mode, both core pieces have the above-described specific shape, and therefore the assembled state of the core pieces is likely to be maintained, and magnetic saturation is more likely to decrease due to including the molded body made of the composite material. Also, in the above-described mode, a later-described gap length is easy to make smaller, and a smaller size is easy to achieve.

Examples of the above-described reactor include an embodiment in which the gap portions are air gaps.

Here, the gap portion can be used as a solid magnetic gap obtained by filling the space forming the above-described gap portion with resin or the like.

On the other hand, if an air gap is used, it is possible to prevent thermal stress, which is caused by the filling material filling the above-described space, from acting on the core pieces. Accordingly, in the above-described mode, magnetic saturation is not likely to occur, the assembled state of the core pieces is easily maintained, and furthermore, excellent strength is also obtained.

Examples of the above-described reactor include an embodiment in which the gap length of the gap portions is greater than 0 and less than or equal to 2 mm.

The gap length in this context refers to the maximum distance along the axial direction of the wound portion in the space formed by the non-contact region.

In the above-described state, the gap length is in the above-described range, and therefore magnetic saturation is not likely to occur, a compact reactor can be achieved, and the assembled state of the core pieces is easily maintained.

Examples of the above-described reactor include an embodiment in which the contact portions each include: a frame-shaped end surface that is provided on the one core piece and surrounds the opening edge of the recessed portion; and a frame-shaped surface that is provided on the other core piece and opposes the frame-shaped end surface.

In the above-described mode, one core piece includes a frame-shaped end surface, and a recessed portion that is more recessed than the end surface, and the other core piece includes a frame-shaped surface that opposes the above-described frame-shaped end surface, and a protruding portion that protrudes from the frame-shaped surface. By assembling these core pieces such that the above-described frame-shaped surfaces are in surface contact with each other, the recessed portion and the protruding portion can automatically engage with each other. Accordingly, in the above-described mode, magnetic saturation is not likely to occur, assembly workability is excellent, and the assembled core pieces are not likely to come apart. Also, due to the frame-shaped surfaces being in surface contact with each other, the above-described space, which functions as a gap portion, can be formed more reliably.

Examples of the above-described reactor include an embodiment in which a resin portion that covers at least part of the outer peripheral surface of at least one of the magnetic core and the coil is included.

In the above-described mode, in particular, if a resin portion integrating the magnetic core is included, the assembled state of the core pieces can be more reliably maintained. In addition, due to equipping the resin portion, it is possible to expect effects such as an improvement in the insulation between the coil and the magnetic core, protection from the external environment and mechanical protection of the coil and the magnetic core, an improvement in the rigidity and strength when the coil and the magnetic core are integrated by the resin portion, and suppression of vibration and noise.

Details of Embodiments of the Disclosure

Hereinafter, a concrete example of a reactor according to an embodiment of the present disclosure will be described with reference to the drawings. In the drawings, like reference numerals denote objects having like names.

Embodiment 1

Figure 2:
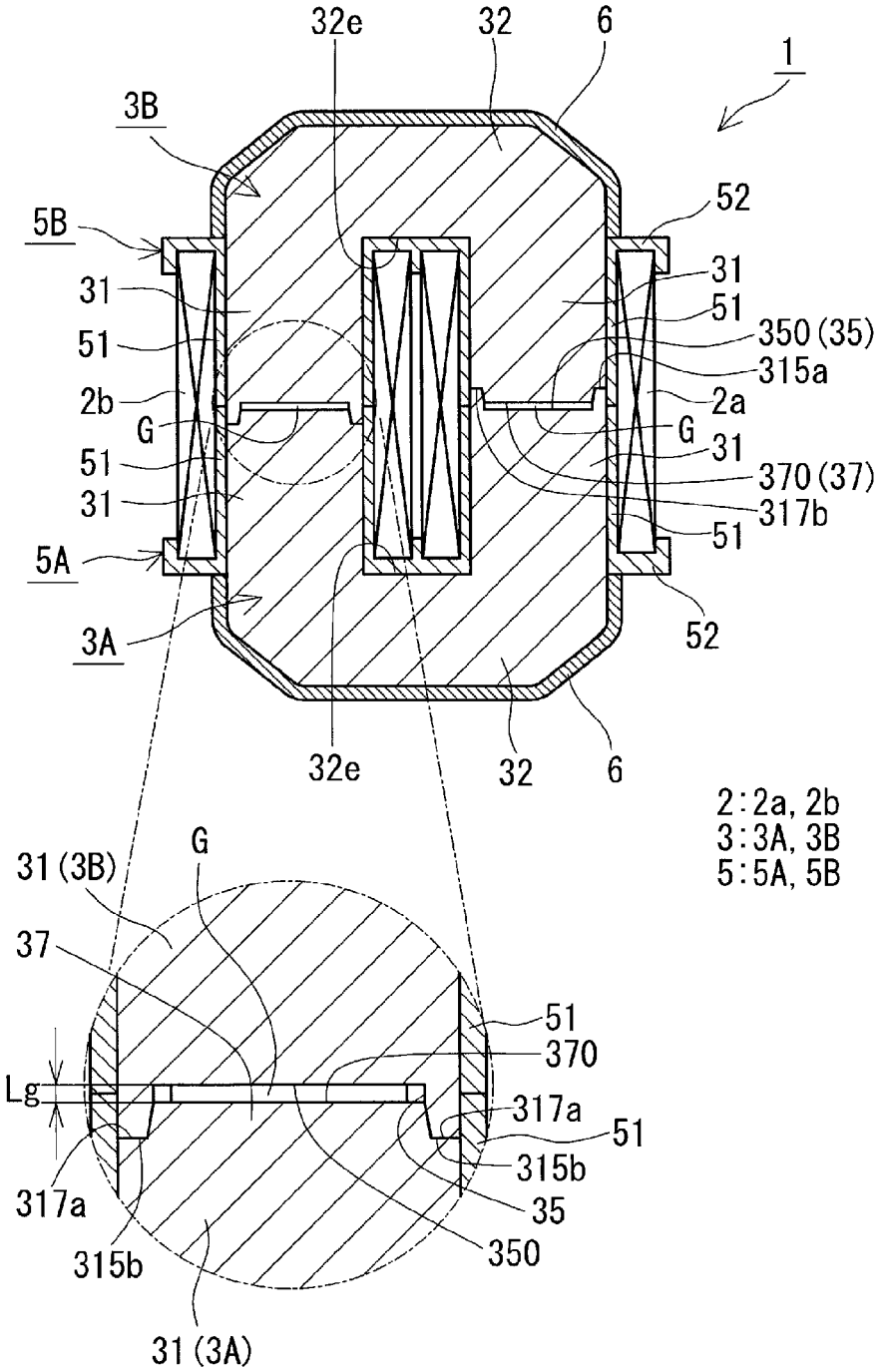
FIG. 2 is a cross-sectional diagram obtained by cutting the reactor of Embodiment 1 along cutting line (II)-(II) shown in FIG. 1.
Figure 3:
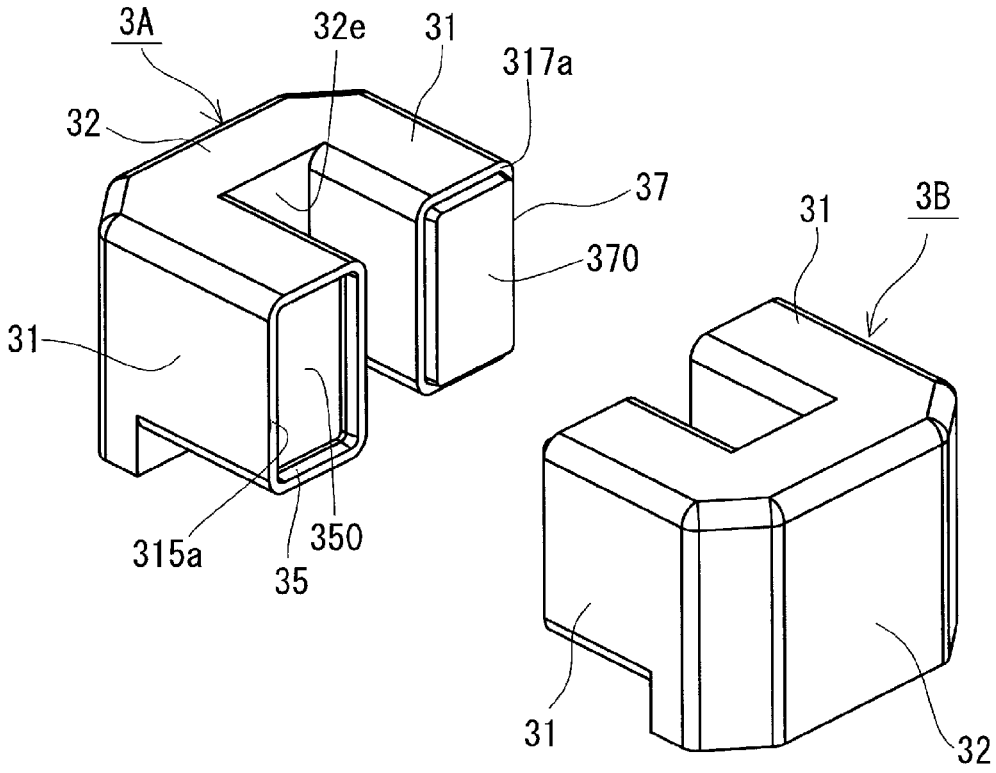
FIG. 3 is an exploded perspective view of a magnetic core included in the reactor of Embodiment 1.
Figure 4:
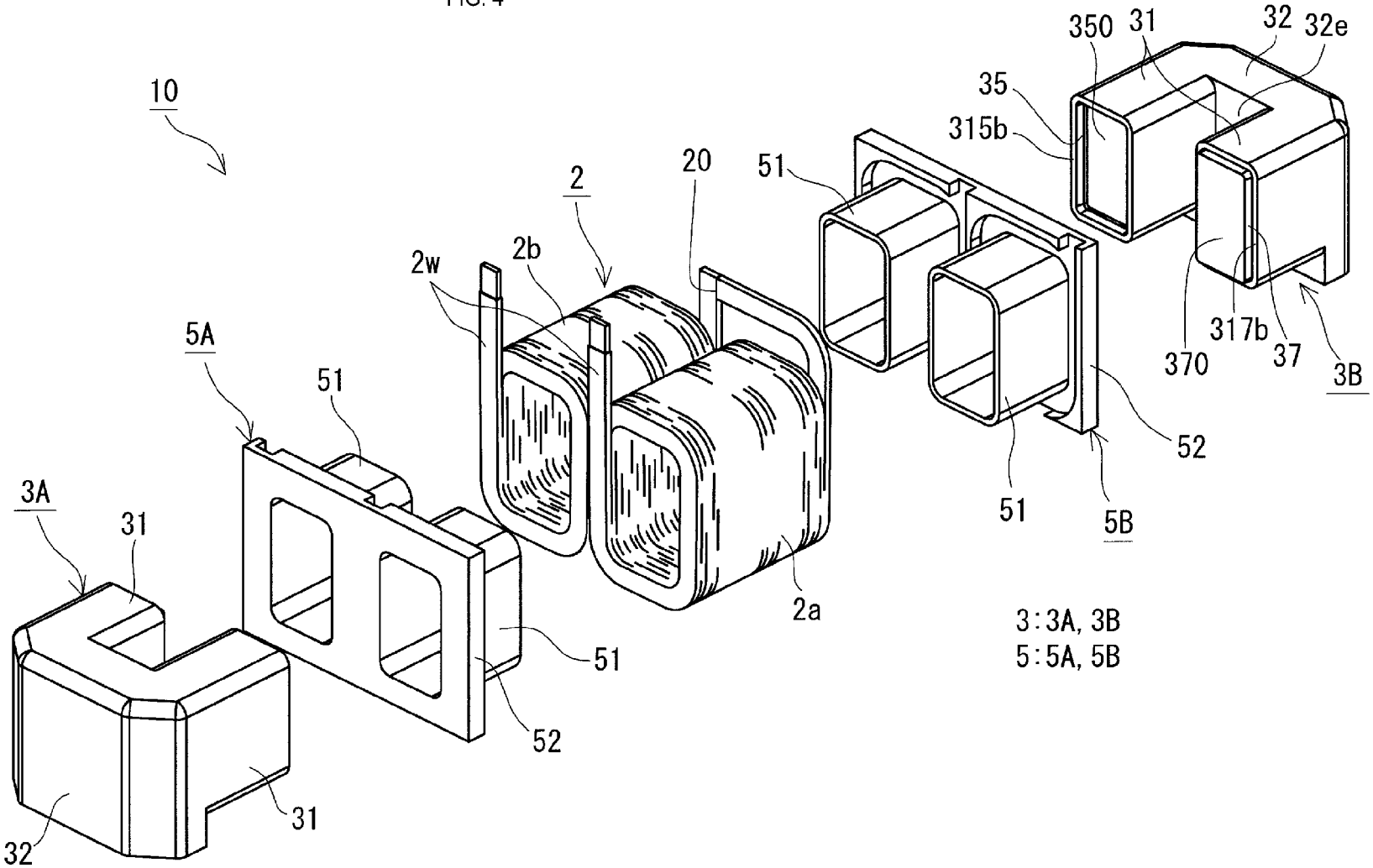
FIG. 4 is an exploded perspective view of a combined body included in the reactor of Embodiment 1.

A reactor 1 of Embodiment 1 will be described with reference to FIGS. 1 to 4. FIG. 2 is a longitudinal cross-sectional view obtained by cutting the reactor 1 with a plane parallel to the axial direction of the coil 2. In FIGS. 1, 3, and 4, a core piece 3A is shown on the left side of the drawing, and a core piece 3B is shown on the right side of the drawing.

Overview

The reactor 1 of Embodiment 1 includes: a coil 2 including a pair of wound portions 2*a* and 2*b* that are formed by winding winding wires 2*w* as shown in FIG. 1; and a magnetic core 3 (see also FIG. 2) that is arranged inside and outside of the wound portions 2*a* and 2*b*. Both wound portions 2*a* and 2*b* are provided side by side such that the axes of the wound portions 2*a* and 2*b* are parallel. The magnetic core 3 includes a set of core pieces that engage with each other. In this example, as shown in FIGS. 3 and 4, the magnetic core 3 includes two core pieces 3A and 3B, and the two core pieces 3A and 3B form a set of core pieces that engage with each other. The core pieces 3A and 3B each include: two inner core portions 31 that are arranged inside of the wound portions 2*a* and 2*b*, and an outer core portion 32 that is arranged outside of the wound portions 2*a* and 2*b* and couples the two inner core portions 31. The end portions of the inner core portions 31 function as engagement locations of the two core pieces 3A and 3B. As shown in FIG. 2, the two core pieces 3A and 3B are assembled in a ring shape due to the end portions of the inner core portions 31 being engaged, and form a closed magnetic path when the coil 2 is excited. Typically, the reactor 1 is used attached to an installation target (not shown) such as a converter case. The reactor 1 of FIG. 1 shows an example of an installation state, and a case is illustrated in which the lower side of FIG. 1 is the installation side of the reactor 1.

As shown in FIG. 2, one core piece 3A in the set of core pieces includes a recessed portion 35 on the end portion of at least one inner core portion 31 (see also FIG. 3), and the other core piece 3B includes a protruding portion 37 that is to be fit into the above-described recessed portion 35, on the end portion of at least one inner core portion 31 (see also FIG. 4). In this example, the core pieces 3A and 3B include recessed portions 35 and protruding portions 37 on the end portions of the inner core portions 31 (see FIG. 2, FIG. 3 for the core piece 3A, and FIG. 4 for the core piece 3B), and the recessed portions 35 and the protruding portions 37 are used as engagement portions. The reactor 1 has two locations at which the protruding portions 37 and the recessed portions 35 engage with each other (FIG. 2). In particular, the reactor 1 of Embodiment 1 includes non-contact regions in which the inner peripheral surfaces forming the recessed portions 35 and the outer peripheral surfaces of the protruding portions 37 are not in contact with each other as shown in FIG. 2 in the engaged state of the recessed portions 35 and the protruding portions 37, and the non-contact regions form gap portions G. In order to form the gap portion G, as shown in FIGS. 3 and 4, the recessed portion 35 has a ring-shaped opening edge that is open toward the partner core piece with which it engages, and the recessed portion 35 typically opens in only one direction. The protruding portion 37 typically has a protrusion length that is smaller than the depth of the recessed portion 35. Also, in the above-described engaged state, the two core pieces 3A and 3B include ring-shaped contact portions that are provided along the opening edges of the above-described recessed portions 35 and come into surface contact with each other. As shown in FIG. 2, the contact portion of this example includes: a set including part (a later-described inclined portion) of the inner peripheral surface forming the recessed portion 35 and part (a later-described inclined surface) of the outer peripheral surface of the protruding portion 37; a frame-shaped end surface (here, a later-described outer end surface 315*a*) that is provided on one core piece 3A and surrounds the opening edge of the recessed portion 35; and a frame-shaped surface (here, a later-described outer end surface 317*b*) that is provided on the other core piece 3B and opposes the frame-shaped end surface of the above-described core piece 3A. In this example, the contact portion includes the set of the outer end surfaces 317*a* and 315*b* in addition to the set of the outer end surfaces 315*a* and 317*b*. The reactor 1 includes the above-described gap portions G and the contact portions inside of the wound portions 2*a* and 2*b*. Hereinafter, detailed description will be given with a focus on the magnetic core 3.

Coil

As shown in FIG. 4, the coil 2 of this example includes: cylindrical wound portions 2*a* and 2*b* that are formed by winding two winding wires 2*w* in a spiral shape; and a bonding portion 20 that is formed by bonding end portions on one side of the two winding wires 2*w*. The coil 2 is a unitary object that is manufactured by arranging side by side the wound portions 2*a* and 2*b* formed by the winding wires 2*w*, bending one end portion of the winding wires 2*w* that extends from the wound portions 2*a* and 2*b* as needed and electrically connecting it to form the bonding portion 20. Various types of welding, soldering, brazing, and the like can be used in the connection of the above-described end portions. Both of the other end portions of the winding wires 2*w* are pulled out in an appropriate direction from the wound portions 2*a* and 2*b* and are electrically connected to an external apparatus (not shown) such as a power source due to terminal fittings (not shown) being attached thereto as needed.

The wound portions 2*a* and 2*b* of this example are both composed of winding wires 2*w* of the same specification and have the same shape, size, winding direction, and number of turns. The winding wires 2*w* are covered rectangular wires or so-called enamel wires including a conductor that is a rectangular wire composed of copper or the like, and an insulating covering composed of polyamide imide or the like, which covers the outer periphery of the conductor. The wound portions 2*a* and 2*b* are edgewise coils with quadrilateral cylinder shapes having rounded corner portions. A known coil can be used as the coil 2, and for example, a coil can be used in which a pair of wound portions 2*a* and 2*b* are formed by one continuous winding wire. The specifications of the winding wires 2*w* and the wound portions 2*a* and 2*b* can be modified as needed.

In addition, in this example, the entirety of the coil 2 is exposed without being covered by a later-described resin molded portion 6. For this reason, the coil 2 can be used in a reactor 1 that more easily dissipates heat to the outside and has excellent heat dissipation properties.

Magnetic Core

Mainly the magnetic core 3 will be described with reference to FIGS. 2 to 4.

The magnetic core 3 of this example includes: two U-shaped core pieces 3A and 3B; and gap portions G (in this example, two; FIG. 2) that are provided at the engagement locations of the two core pieces 3A and 3B. The core pieces 3A and 3B of this example have the same shape. For example, if the core piece 3B is rotated 180 degrees in the horizontal direction from the state shown in FIG. 3, it matches the core piece 3A.

Core Piece

The core pieces 3A and 3B of this example include inner core pieces 31 and outer core pieces 32 as with the above-described two core pieces, and the core pieces 3A and 3B are molded bodies that are each molded in one piece. Both of the inner core portions 31 of this example are cuboid-shaped with rounded corner portions (FIG. 3), a recessed portion 35 being provided on one end portion side of one inner core portion 31, and a protruding portion 37 being provided on one end portion side of the other inner core portion 31. Both inner core portions 31 have substantially the same shape and size, except near the end portions on which the recessed portion 35 and the protruding portion 37 are formed. The details of the recessed portion 35 and the protruding portion 37 will be described later.

The outer core portion 32 of this example is hexagonal column-shaped, and the inner core portions 31 protrude toward the wound portions 2*a* and 2*b* from the surface (inner end surface 32*e*) opposing the wound portions 2*a* and 2*b*.

Also, the outer core portions 32 of this example protrude such that the surfaces (lower surfaces in FIG. 3) on the installation side are closer to the installation target than the surfaces (lower surfaces in FIG. 3) on the installation side of the inner core portions 31 (here, the outer core portions 32 protrude downward), and thus the outer core portions 32 are substantially level with the surfaces (lower surface in FIG. 1) on the installation side of the wound portions 2*a* and 2*b*. The reactor 1 is likely to stably maintain the installation state due to the surfaces on the installation side of the wound portions 2*a* and 2*b* and the outer core portions 32 being used as the installation surface of the reactor 1.

Shapes of Recessed Portions and Protruding Portions

In this example, the end surfaces of the inner core portions 31 included in the core pieces 3A and 3B both have stepped shapes (FIG. 3). The end surface of one inner core portion 31 has a stepped shape in which the region on the outer edge side is high and the region on the inner side is lower than the outer edge.

The end surface of the other inner core portion 31 has a stepped shape in which the region on the outer edge side is low, and the region on the inner side is higher than the outer edge. The recessed portion 35 and the protruding portion 37 are formed by the stepped shapes.

Specifically, the end portion of one inner core portion 31 is a rectangular frame shape that corresponds to the outer shape of the inner core portion 31, and includes: an outer end surface 315*a* that includes the outer edge of the inner core portion 31; a rectangular inner end surface 350 that is located toward the outer core portion 32 with respect to the inner edge of the frame-shaped outer end surface 315*a* and corresponds to the outer shape of the inner core portion 31; and an inner peripheral wall surface that connects the two end surfaces 315*a* and 350 and is continuous in the peripheral direction of the inner core portion 31. The recessed portion 35 has a shape that is formed by the inner end surface 350 and the inner peripheral wall surface and is closed in the peripheral direction of the inner core portion 31. Also, the recessed portion 35 is open in only one direction, that is, the direction toward the end surface 315*a*. The outer peripheral surface of the inner core portion 31 including this kind of recessed portion 35 is level over the entire axial direction (substantially equal to the axial direction of the wound portions 2*a* and 2*b*) of the inner core portion 31, and has a uniform appearance. In this example, the end surfaces 315*a* and 350 are composed of parallel flat surfaces that are perpendicular to the axial direction of the inner core portion 31. As shown enlarged in the one-dot chain line circle of FIG. 2, the inner peripheral wall surface is composed of an inclined surface that intersects the axial direction of the inner core portion 31 in the region on the opening edge side of the recessed portion 35, and is composed of a surface (surface of a cylindrical shape) that is parallel to the axial direction of the inner core portion 31 in the region on the inner end surface 350 side. The inclined surface is provided such that the opening width becomes narrower from the opening edge of the recessed portion 35 to the inner end surface 350. The longitudinal cross-sectional shape of the recessed portion 35 is a trapezoidal shape on the opening edge side and a rectangular shape on the inner end surface 350 side, as shown in FIG. 2.

The end portion of the other inner core portion 31 has a rectangular frame shape that corresponds to the outer shape of the inner core portion 31, and includes: an outer end surface 317*a* that includes the outer edge of the inner core portion 31; a rectangular inner end surface 370 that protrudes toward the side opposite to the outer core portion 32 with respect to the inner edge of the frame-shaped outer end surface 317*a* and corresponds to the outer shape of the inner core portion 31; and an outer peripheral wall surface that connects the two end surfaces 317*a* and 370 and is continuous in the peripheral direction of the inner core portion 31. The protruding portion 37 has a truncated cone shape that is formed by the inner end surface 370 and the outer peripheral wall surface. The outer peripheral surface of the other inner core portion 31 including this protruding portion 37 is level over the entire axial direction of the inner core portion 31, except for the protruding portion 37, and has a uniform appearance. In this example, the end surfaces 317*a* and 370 are composed of parallel flat surfaces. The outer peripheral wall surface is an inclined surface having an incline that corresponds to the inclined surface of the above-described inner peripheral wall surface. The longitudinal cross-sectional shape of the protruding portion 37 is a trapezoidal shape as shown in FIG. 2.

Engagement State of Recessed Portion and Protruding Portion

When the recessed portion 35 and the protruding portion 37 are engaged with each other, the inclined surface on the opening edge side that forms the recessed portion 35 exists so as to surround the entire periphery of the outer peripheral wall portion (inclined surface) of the protruding portion 37, and part (inclined surface) of the inner peripheral wall portion forming the recessed portion 35 and the outer peripheral wall portion of the protruding portion 37 come into contact with each other as shown in FIG. 2. The contact region between the recessed portion 35 and the protruding portion 37 is provided in the form of a ring along the opening portion of the recessed portion 35 and forms part of the contact portion. Due to the above-described contact between the recessed portion 35 and the protruding portion 37, the movement of the core pieces 3A and 3B is substantially restricted, except in the direction toward the outer core portion 32, and thus the engagement state can be maintained. Also, the contact region forms part of a magnetic path and functions to form a later-described enclosed space.

Even if the recessed portion 35 and the protruding portion 37 are engaged with each other, the surface of the cylindrical shape on the inner end surface 350 side forming the recessed portion 35 and the inner end surface 350, and the inner end surface 370 of the protruding portion 37 do not come into contact with each other, and a gap corresponding to the size of the above-described surface of the cylindrical shape is provided between the two end surfaces 350 and 370. The non-contact region between the recessed portion 35 and the protruding portion 37 forms a substantially enclosed space, and this space is the gap portion G. In this example, the two inner end surfaces 350 and 370 are arranged in parallel as shown in FIG. 2, and a gap of a substantially uniform thickness is provided between the two inner end surfaces 350 and 370 and functions as a magnetic gap. It is sufficient to adjust the size of the non-contact region between the recessed portion 35 and the protruding portion 37 so as to achieve a predetermined magnetic gap. Typically, the protrusion length of the protruding portion 37 is made smaller compared to the depth of the recessed portion 35. In this example, the protrusion length of the protruding portion 37 is shorter by an amount corresponding to the size of the above-described surface of the cylindrical shape.

The shapes, sizes, and the like of the recessed portion 35 and protruding portion 37 shown in FIGS. 2 to 4 are illustrative. The shapes, sizes, and the like of the recessed portion 35 and the protruding portion 37 can be changed as appropriate in a range in which they can engage with each other and form a gap portion G of a predetermined size using the contact region and the non-contact region. For example, the opening shape of the recessed portion 35 and the outer shape of the protruding portion 37 can be shapes that do not correspond to the outer shape of the inner core portion 31 (the above-described opening shape is circular, the protruding portion 37 is a circular column shape, etc.). Alternatively, for example, the inner end surfaces 350 and 370 can be arc-shaped curved surfaces instead of flat surfaces. Alternatively, for example, there can be many protruding portions 37 instead of just one (see later-described Embodiment (g)). If the opening shape of the recessed portion 35 and the outer shape of the protruding portion 37 are made to correspond to the outer shape of the inner core portion 31 as in the present example, it is easy to ensure a large amount of space in which to form the above-described gap (it is easy to reduce the maximum thickness between the outer peripheral surface of the inner core portion 31 and the inner peripheral wall portion of the recessed portion 35), and it is easy to obtain a magnetic core 3 that includes a large magnetic gap and is not likely to undergo magnetic saturation. If the inner end surfaces 350 and 370 are flat surfaces as in the present example, it is easy to adjust the later-described gap length Lg. As in the present example, if there is one protruding portion 37 and the two inner end surfaces 350 and 370 are flat surfaces as described above, the gap length Lg is easy to adjust.

Outer End Surface

In this example, the frame-shaped outer end surface 315*a* that surrounds the opening edge of the recessed portion 35 of one core piece 3A and the outer end surface 317*b* that opposes the above-described outer end surface 315*a* of the other core piece 3B come into surface contact with each other to form part of the contact portion. Similarly, the outer end surface 315*b* of the other core piece 3B and the outer end surface 317*a* that opposes the above-described outer end surface 315*b* of the one core piece 3A come into surface contact with each other to form part of the contact portion. In the process of manufacturing the reactor 1, the recessed portion 35 and the protruding portion 37 can automatically be engaged with each other by bringing the two core pieces 3A and 3B near each other until they come into contact with each other in the set of the outer end surfaces 315*a* and 317*b* and the set of the outer end surfaces 317*a* and 315*b* (hereinafter referred to overall as sets of outer end surfaces and the like in some cases), when assembling the two core pieces 3A and 3B. Accordingly, as in the present example, with the reactor 1 that includes the sets of outer end surfaces and the like, the recessed portion 35 and the protruding portion 37 can be easily and accurately assembled. Also, due to the set of outer end surfaces and the like also coming into surface contact in addition to the recessed portion 35 and the protruding portion 37, the above-described enclosed space that functions as the above-described gap portion G can be formed more reliably.

Here, the sets of outer end surfaces and the like function as a magnetic path. For this reason, if the sizes (here, the frame width) of the outer end surfaces 315*a*, 315*b*, 317*a*, and 317*b* are excessively large, a gap portion with a predetermined size cannot be ensured, and the effect of reducing magnetic saturation is more difficult to obtain. From the viewpoint of reducing magnetic saturation, it is preferable to reduce the above-described size as much as possible. For example, by omitting the outer end surfaces, the recessed portion 35 included in one core piece can be given a trapezoidal cross-sectional shape with an opening edge that extends to the outer peripheral surface of the one core piece, and the protruding portion 37 included in the other core piece can be given a trapezoidal cross-sectional shape in which the peripheral edge of the inclined surface of the protruding portion reaches the outer peripheral surface of the other core piece. On the other hand, if the outer end surfaces are included as in the present example, the space forming the gap portion G can be formed more reliably as described above, the strength near the opening edge of the recessed portion 35 is increased, and chipping, breakage, and the like of the core pieces 3A and 3B are easier to prevent. For example, the surface area of the outer end surfaces 315*a*, 315*b*, 317*a*, and 317*b* is set to about 10% or more and 50% or less, and furthermore 20% or more and 40% or less of the magnetic path cross-sectional area of locations other than the forming location of the recessed portion 35 and the protruding portion 37 of the inner core portion 31. In addition, in the present example, the outer end surfaces were flat surfaces perpendicular to the axial direction of the inner core portion 31, but they can be intersecting flat surfaces that are not perpendicular, or the like.

Gap Length

The size of the gap length Lg of the gap portion G can be selected as needed. The gap length Lg is the maximum distance along the axial direction of the wound portions 2*a* and 2*b* in the space formed by the above-described non-contact region. In this example, the gap length Lg is the above-described maximum distance between the inner end surfaces 350 and 370. In this example, the inner end surfaces 350 and 370 comprised of flat surfaces are arranged in parallel as described above, and therefore the distance along the axial direction of the wound portions 2*a* and 2*b* is substantially uniform between the inner end surfaces 350 and 370. For this reason, the reactor 1 (magnetic core 3) of this example includes two magnetic gaps with a uniform thickness.

The size of the gap length Lg of one gap portion G also depends on the size of the reactor 1, the size of the contact portion, and the like, but for example, it is greater than 0 mm and 2 mm or less. If the gap length Lg is greater than 0 mm, the magnetic core 3 can include a location at which the magnetic path surface area is locally small. In this example, the size of the magnetic path surface area at the engagement location of the recessed portion 35 and the protruding portion 37 can correspond to the contact surface area of the above-described set of outer end surfaces or the like. The magnetic saturation can be reduced by locally reducing the magnetic path surface area. The larger the gap length Lg is, the more the magnetic saturation can be reduced, and the gap length Lg can be set to 0.01 or more, 0.1 mm or more, 0.3 mm or more, and 0.5 mm or more. On the other hand, if the gap length is 2 mm or less, the recessed portion 35 and the protruding portion 37 easily engage with each other, excellent assembly workability is obtained, and loss caused by magnetic flux leakage from the gap portion G is easy to reduce. Furthermore, it is easy to achieve a smaller size. The smaller the gap length Lg is, the more excellent the assembly workability is, and the easier it is to achieve low loss and a smaller size, and therefore the gap length Lg can be set to 1.9 mm or less, 1.8 mm or less, or 1.5 mm or less.

Note that although the magnetic core 3 includes the gap portion G, a magnetic component is present so as to cover the space forming the gap portion G. That is, in the reactor 1, the magnetic component exists over the entire length of the wound portions 2*a* and 2*b* in the wound portions 2*a* and 2*b*, and a portion of the magnetic flux that bypasses the gap portion G can pass through the above-described magnetic component. Accordingly, it is thought that the reactor 1 more easily reduces magnetic flux leakage from the gap portion G to the coil 2 compared to the case (see JP 2017-027973A) in which no magnetic component is present between the wound portions 2*a* and 2*b* and the gap. If the gap length Lg is shortened, magnetic flux leakage to the coil 2 is even more easily reduced.

Material of Gap Portion

The gap portion G can have a mode in which an air gap or the above-described space is filled with a non-magnetic material such as resin, and includes a filling. If the gap portion G is an air gap as in the present example, thermal stress or the like caused by the above-described filling can be prevented from acting on the core pieces 3A and 3B, and excellent strength is obtained.

Constituent Materials

The core pieces 3A and 3B are molded bodies formed into a predetermined shape and size. The core pieces 3A and 3B may be composed of molded bodies of a composite material including a magnetic powder and a resin, a pressed powder molded body obtained by press-molding a raw material powder mainly including a magnetic powder, a stacked body obtained by stacking plate materials comprising a soft magnetic material such as a silicon sheet, a sintered body such as a ferrite core, and the like. The core pieces 3A and 3B of this example are molded bodies of a composite material.

The molded bodies of a composite material may be manufactured through a suitable molding method such as injection molding or cast molding. In the molded body of the composite material, resin is interposed between powder particles of the magnetic powder. For this reason, compared to the above-described pressed powder molded body, stacked body, or the like, the relative permeability is easier to reduce and the gap length Lg of the gap portion G is easier to reduce. Furthermore, with the molded body of the composite material, it is possible to expect effects such as iron loss such as eddy current loss being easy to reduce and it being easy to obtain a low-loss core piece, and being able to easily perform molding and having excellent manufacturability even if the shape is a complex three-dimensional shape. If the core pieces 3A and 3B have the same shape as in the present example, excellent manufacturability is also obtained due to being able to perform molding with the same mold.

The magnetic material included in the magnetic powder may be a metal, a non-metal, or the like that is a soft magnetic material. Examples of the metal include pure iron substantially composed of Fe; an iron-based alloy including various additional elements, the remaining portion being composed of Fe and unavoidable impurities; an iron group metal other than Fe or an alloy thereof and the like. Examples of the iron-based alloy include Fe—Si alloy, Fe—Si—Al alloy, Fe—Ni alloy, Fe—C alloy, and the like. Examples of the non-metal include ferrite.

Examples of the resin included in the composite material include thermosetting resin, thermoplastic resin, room-temperature curable resin, and low-temperature curable resin. Examples of the thermoplastic resin include: polyphenylene sulfide (PPS) resin; polytetrafluoroethylene (PTFE) resin; liquid crystal polymer (LCP); polyamide (PA) resins such as nylon 6 and nylon 66; polybutylene terephthalate (PBT) resin; and acrylonitrile butadiene styrene (ABS) resin. Examples of the thermosetting resin include: unsaturated polyester resin; epoxy resin; urethane resin; and silicone resin. In addition, it is also possible to use: a BMC (bulk molding compound), which is obtained by mixing calcium carbonate and glass fibers into unsaturated polyester; a mineral-type silicone rubber; a mineral-type urethane rubber; or the like.

The content of the magnetic powder in the composite material may be 30 vol % or more and 80 vol % or less, and 50 vol % or more and 75 vol % or less. The content of the resin in the composite material may be 10 vol % or more and 70 vol % or less, and 20 vol % or more and 50 vol % or less. Also, the composite material can contain a filler powder composed of a non-magnetic and non-metal material such as alumina or silica, in addition to the magnetic powder and the resin. The content of the filler powder may be 0.2 mass % or more and 20 mass % or less, 0.3 mass % or more and 15 mass % or less, and 0.5 mass % or more and 10 mass % or less. The greater the content of the resin is, the smaller the relative permeability is, and thus the less likely magnetic saturation is to occur, the more the insulation can be increased, and the more the eddy current loss is reduced, making it easier to obtain low loss. Since magnetic saturation is not likely to occur, the gap length Lg is also easily reduced, and it is easy to obtain a compact magnetic core 3. In the case of including the filler powder, low iron loss resulting from an improvement in insulation, an improvement in the heat dissipation property, and the like can be expected.

Other Members

A combined body 10 obtained by combining the coil 2 and the magnetic core 3 can also be used as-is as the reactor 1. Furthermore, the reactor 1 can include a resin portion that covers at least part of the outer peripheral surface of at least one of the magnetic core 3 and the coil 2. The reactor 1 in this example includes an interposed member 5 as a resin portion that is interposed between the coil 2 and the magnetic core 3, and includes a resin mold portion 6 that covers part of the outer core portion 32 as a resin portion that covers at least part of the outer peripheral surface of the magnetic core 3.

Interposed Member

The interposed member 5 of this example includes a pair of divided interposed pieces 5A and 5B that are divided in the axial direction of the wound portions 2*a* and 2*b* of the coil 2 as shown in FIG. 4. The divided interposed pieces 5A and 5B include inner interposed portions 51 that are interposed between the wound portions 2*a* and 2*b* and the inner core portions 31; and a frame portion 52 that is interposed between the end surfaces of the wound portions 2*a* and 2*b* and the inner end surface 32*e* of the outer core portion 32.

The inner interposed portion 51 of this example is a cylinder that conforms to the outer shape of the inner core portion 31 and covers the entire periphery of the inner core portion 31. When the two divided interposed pieces 5A and 5B are assembled, the end surfaces of the cylindrical inner interposed portions 51 abut against each other (FIG. 2) and form a cylinder that is continuous in the wound portions 2*a* and 2*b*.

The frame portion 52 of this example is a B-shaped member that includes two through holes into which the parallel inner core portions 31 are inserted. The inner interposed portions 51 are extended from the opening edges of the through holes of the frame portion 52 to the wound portions 2*a* and 2*b*. Also, in this example, a groove into which a portion of the wound portions 2*a* and 2*b* fits is included in a region on the wound portions 2*a* and 2*b* side of one (in FIG. 4, the right side) frame portion 52, and one end surface of the wound portions 2*a* and 2*b* is in close contact therewith. For this reason, when the wound portions 2*a* and 2*b*, the core pieces 3A and 3B, and the divided interposed pieces 5A and 5B are combined, the wound portions 2*a* and 2*b* can be accurately positioned with the above-described grooves with respect to the interposed member 5, and the core pieces 3A and 3B can be accurately positioned with the inner interposed portions 51. As a result, the coil 2 and the magnetic core 3 can be accurately positioned via the interposed member 5. Note that the installation surfaces of the frame portions 52 of the divided interposed pieces 5A and 5B are level with the installation surfaces of the wound portions 2*a* and 2*b* and the installation surfaces of the outer core portions 32 (FIG. 1).

The shape of the interposed member 5 is illustrative and can be changed as needed. For example, if the length of the inner interposed portion 51 is made shorter than the inner core portion 31, and a through hole, a groove, and the like are provided in the inner interposed portions 51 and the like, the constituent materials of the interposed member 5 can be reduced, and a reduction in weight can be achieved. Alternatively, for example, it is possible to achieve a shape in which the inner interposed portions 51 of the two divided interposed pieces 5A and 5B engage with each other.

The constituent materials of the interposed member 5 may be an insulating resin such as various types of thermoplastic resins described in the section "Constituent Materials". The thickness of the inner interposed portion 51, the thickness of the portion interposed between the wound portions 2*a* and 2*b* in the frame portions 52 and the inner end surface 32*e* of the outer core portion 32, and the like can be selected as appropriate within a range in which a predetermined insulation property is satisfied.

Resin Molded Portion

The resin molded portion 6 of this example mainly covers the region of the outer peripheral surface of the outer core portion 32 excluding the installation surface and the inner end surface 32*e*, with a uniform thickness, as shown in FIGS. 1 and 2. Since the above-described region is exposed to the outside environment, by covering the region with the resin molded portion 6, it is possible to achieve protection from the outside environment, mechanical protection, an improvement in insulation between the outer core portion 32 and the outer component, and the like.

The covering region, thickness, and the like of the resin molded portion 6 can be changed as needed. For example, the entire outer periphery of the magnetic core 3 can be substantially covered. In this case, the core pieces 3A and 3B can be kept in one piece using the resin molded portion 6, and the rigidity and strength of the magnetic core 3 as an integrated member can be increased.

The core pieces 3A and 3B of this example are composed of a molded body of a composite material as described above, and include a resin component, and therefore even if there is no resin molded portion 6, it is possible to expect protection from the outside environment, ensurement of insulation, and the like to a certain degree, but if the resin molded portion 6 is further included as in this example, the above-described effects are even more easily obtained.

Examples of the constituent materials of the resin molded portion 6 include insulating resins such as the various types of thermoplastic resin described in the section "Constituent Materials" and the various types of thermosetting resin. As long as the insulating resin contains a non-magnetic and non-metallic powder such as alumina, the heat dissipation property, electrical insulation, and the like can be improved. The resin molded portion 6 may be formed through various types of molding methods, such as injection molding, by storing the combined body 10 obtained by combining the coil 2, the magnetic core 3, and the interposed member 5 shown in FIG. 4 in a mold. A mold with an appropriate shape that can cover the predetermined region (in this example, mainly part of the outer peripheral surface of the outer core portion 32) can be used as the mold. Thermoplastic resin is easily used in injection molding.

Application

The reactor 1 of Embodiment 1 can be used in various converters such as a converter for an air conditioner or an in-vehicle converter (typically a DC-DC converter) to be mounted in a vehicle such as a hybrid automobile, a plug-in hybrid automobile, an electric automobile, or a fuel-cell automobile, or a constituent component of a power conversion apparatus. In particular, the magnetic core 3 including the core pieces 3A and 3B composed of molded bodies of a composite material have lower loss compared to the case of including core pieces composed of pressed powder molded bodies or stacked bodies obtained by stacking electromagnetic steel plates, and therefore the magnetic core 3 can be preferably used as a reactor or the like for high-frequency applications.

Main Effects

The reactor 1 of Embodiment 1 includes core pieces 3A and 3B that are engaged to each other, and the engagement portions are recessed portions 35 that have ring-shaped opening edges and open in only one direction and protruding portions 37 that are fit into the recessed portions 35. Accordingly, the core pieces 3A and 3B of the reactor 1 are easily assembled and have excellent assembly workability, movement of the two engaged core pieces 3A and 3B can be restricted, and the assembled state can be maintained. The reactor 1 also has excellent manufacturability from the viewpoint that an adhesive agent can be omitted from the fixing of the core pieces 3A and 3B. The two core pieces 3A and 3B include a set of frame-shaped outer end surfaces and the like, and by bringing the two core pieces 3A and 3B near each other until the frame-shaped outer end surfaces come into contact with each other, the recessed portion 35 and the protruding portion 37 can be engaged with each other, and therefore the reactor 1 of this example is easily assembled. Also, due to the fact that ring-shaped contact regions (contact portions) are included on the inner peripheral surface of the recessed portion 35 and the outer peripheral surface of the protruding portion 37, the core pieces 3A and 3B are not likely to rattle, and the reactor 1 of this example easily maintains the assembled state.

Furthermore, since the gap portion G formed through the engagement between the recessed portion 35 and the protruding portion 37 is included in the wound portions 2*a* and 2*b*, the reactor 1 of Embodiment 1 is not likely to undergo magnetic saturation even if the usage current becomes large. The reactor 1 in this example is not likely to undergo magnetic saturation also due to the fact that the two core pieces 3A and 3B are composed of molded bodies of a composite material. Also, the reactor 1 of this example is not likely to undergo magnetic saturation also due to the fact that a gap portion G is included in an inner region through which a magnetic flux is not likely to pass in the inner core portion 31, and the gap length Lg can be efficiently adjusted by adjusting the interval between the inner end surfaces 350 and 370, which are composed of flat surfaces. The reactor 1 has low loss due to the fact that the gap portions G are included in the wound portions 2*a* and 2*b*, and due to the fact that the two core portions 3A and 3B are composed of molded bodies of a composite material. From the viewpoint that the gap plate is not needed while the gap portion G is included, the reactor 1 also has excellent manufacturability.

Furthermore, due to a magnetic component being present surrounding the gap portion G, the gap portion G is included, but the reactor 1 of Embodiment 1 easily reduces magnetic flux leakage from the gap portion G and can reduce loss caused by magnetic flux leakage. Note that the magnetic component is of a small size such that the above-described space forming the gap portion G can be formed (in this example, approximately the size of the contact region formed by the above-described set of outer end surfaces), and the reactor 1 can suitably obtain the effect of reducing the magnetic saturation using the gap portion G.

In addition, the reactor 1 of this example also exhibits the following effects.

Since the two core pieces 3A and 3B are composed of molded bodies of a composite material, the gap length Lg is easily reduced and a smaller size is easily obtained.

Since the reactor 1 includes the interposed member 5, by including the resin molded portion 6, which can improve insulation between the coil 2 and the magnetic core 3, it is possible to expect effects such as protection from the outside environment of the magnetic core 3 (in particular, the outer core portion 32), mechanical protection, an improvement in rigidity and strength, and the like.

The resin molded portion 6 can be said to keep the interposed member 5, the coil 2 held in the interposed member 5, and the core pieces 3A and 3B including the outer core portion 32 in one piece by covering part of the surface on the outer core portion 32 side of the frame portion 52 of the interposed member 5 as well. For this reason, it is possible to expect improvements in the rigidity and strength and the like of the integrated member of the combined body 10 achieved through the resin molded portion 6 of the reactor 1 of this example. (δ) Excellent heat dissipating properties are also achieved since the coil 2 is exposed to the outside environment.

In another embodiment, for example, a reactor including the following configuration is given.

There are three or more core pieces included in the magnetic core 3.

For example, the inner core portion 31 may be multiple inner core pieces, and the recessed portions 35 and the protruding portions 37 may be included in the inner core pieces.

The shape of the core pieces included in the magnetic core 3 is J-shaped.

For example, the lengths of the inner core portions 31 are not made equal, but are made different in the core pieces 3A and 3B described in Embodiment 1. That is, the core pieces may each include the outer core portion 32, an inner core piece that is relatively long, and an inner core piece that is relatively short, and the recessed portions 35 and the protruding portions 37 may be included at the end portions of the inner core portions.

In addition, the recessed portion 35 and the protruding portion 37 can be included at the end portions of leg portions on which at least the wound portions of the coil are arranged, among two side leg portions and one central leg portion included in an EI-type core, and EE-type core, or the like.

The shape of the core pieces included in the magnetic core 3 is L-shaped.

For example, in the core pieces 3A and 3B described in Embodiment 1, one inner core portion 31 is omitted, and the length of the other inner core portion 31 is increased. That is, the core pieces may each include the outer core portion 32 and one long inner core portion, and the recessed portion 35 and the protruding portion 37 may be included in the inner end surface 32*e* of the outer core portion 32 and the end portion of the long inner core portion. In this case, the gap portion G is provided in the wound portions 2*a* and 2*b* by adjusting the sizes of the recessed portion and the protruding portion.

The outer core portions 32 and the inner core portions 31 are divided.

In this case, if the core pieces forming the outer core portions 32 and the core pieces forming the inner core portions 31 include engagement portions for engaging with each other, assembly is easy. The engagement portion can have a shape similar to that of the recessed portion 35 and the protruding portion 37, but if the magnetic gap is not needed, any engagement shape can be used. It is also possible to not include the engagement portions and to fix the core pieces with an adhesive agent or the like.

The shape of the inner core portion 31 is a shape including a curved surface on its outer peripheral surface, such as a circular column shape or an elliptical column shape, or a polygonal column shape such as a hexagonal column.

Only the recessed portion 35 is included in one core piece 3A and only the protruding portion 37 is included in the other core piece 3B.

There is not one, but multiple protruding portions.

In this case, the shape, position, and number of the multiple protruding portions need only be selected with respect to the ring-shaped opening edge of the recessed portion 35 such that the movement of the two core pieces 3A and 3B can be restricted by fitting the multiple protruding portions 37 into the recessed portion 35. For example, the protruding portions 37 may be provided using, as the forming position, the positions corresponding to two corner portions at diagonal positions, three corner portions, or four corner portions of a rectangular shape at the end portion of the other core piece 3B with respect to a rectangular frame-shaped recessed portion 35 provided in one core portion 3A shown in FIG. 3. This core piece 3B is provided with the multiple protruding portions 37 spaced apart from each other on the rectangular end surface. Due to this end surface and the outside end surface 315*a* on the recessed portion 35 side coming into surface contact with each other, it is possible to form a substantially enclosed space, and the gap portion G can be included.

At least one of the following modifications or additions can be added to the above-described Embodiment 1 or the like.

A sensor (not shown) for measuring a physical amount of the reactor 1 or the like, such as a temperature sensor, a current sensor, a voltage sensor, or a magnetic flux sensor, is included.

A heat dissipation plate is included at the exposure location of the wound portions 2*a* and 2*b*.

At least one of the interposed member 5 and the resin molded portion 6 is omitted.

The resin molded portion 6 keeps the magnetic core 3 in one piece.

The resin molded portion 6 keeps the coil 2 in one piece.

The resin molded portion 6 keeps the combined body 10 (may or may not include the interposed member 5) including the coil 2 and the magnetic core 3 in one piece.

The resin molded portion 6 is modified to a resin portion that includes a case (not shown) that stores the combined body 10 and seals the combined body 10 stored in the case.

A thermal welding resin portion (not shown) that bonds adjacent turns included in the wound portions 2*a* and 2*b* is included.

The present disclosure is not limited to the following examples, but rather is defined by the claims. All changes that come within the meaning and range of equivalency of the claims are intended to be embraced therein.

The invention claimed is:

1. A reactor comprising:

a coil including wound portions; and a magnetic core that includes a set of core pieces that engage with each other and is arranged inside and outside of the wound portions, wherein one core piece in the set of core pieces includes, at an end portion thereof, a recessed portion having a ring-shaped opening edge that is open toward the other core piece, the other core piece includes, at an end portion thereof, a protruding portion that is configured to be fit into the recessed portion, both of the core pieces include, in the wound portions, ring-shaped contact portions that are provided along the opening edges and at which the core pieces come into surface contact with each other, and gap portions that are formed by non-contact regions in which the inner peripheral surfaces forming the recessed portions and the outer peripheral surfaces of the protruding portions are not in contact with each other, both of the core pieces are molded bodies of a composite material including a magnetic powder and a resin, and the content of the resin in the composite material is 10 vol % or more and 70 vol % or less, the inner peripheral surfaces forming the recessed portions include, on the opening edge sides, inclined surfaces that intersect an axial direction of the wound portions, the inclined surfaces of the recessed portions are formed continuously in the peripheral direction of the opening edges and are provided such that the opening widths decrease moving away from the opening edges, the outer peripheral surfaces of the protruding portions include inclined surfaces having inclines that correspond to the inclined surfaces of the recessed portions, and the ring-shaped contact portions include ring-shaped contact regions formed by the inclined surfaces of the recessed portions and the inclined surfaces of the protruding portions.

2. The reactor according to claim 1, wherein the gap portions are air gaps.

3. The reactor according to claim 1, wherein the gap length of the gap portions is greater than 0 and less than or equal to 2 mm.

4. The reactor according to claim 1, wherein the contact portions each include: a frame-shaped end surface that is provided on the one core piece and surrounds the opening edge of the recessed portion; and a frame-shaped surface that is provided on the other core piece and opposes the frame-shaped end surface.

5. The reactor according to claim 1, comprising a resin portion that covers at least part of the outer peripheral surface of at least one of the magnetic core and the coil.

6. The reactor according to claim 2, wherein the gap length of the gap portions is greater than 0 and less than or equal to 2 mm.

7. The reactor according to claim 2, wherein the contact portions each include: a frame-shaped end surface that is provided on the one core piece and surrounds the opening edge of the recessed portion; and a frame-shaped surface that is provided on the other core piece and opposes the frame-shaped end surface.

8. The reactor according to claim 3, wherein the contact portions each include: a frame-shaped end surface that is provided on the one core piece and surrounds the opening edge of the recessed portion; and a frame-shaped surface that is provided on the other core piece and opposes the frame-shaped end surface.

9. The reactor according to claim 2, comprising a resin portion that covers at least part of the outer peripheral surface of at least one of the magnetic core and the coil.

10. The reactor according to claim 3, comprising a resin portion that covers at least part of the outer peripheral surface of at least one of the magnetic core and the coil.

11. The reactor according to claim 4, comprising a resin portion that covers at least part of the outer peripheral surface of at least one of the magnetic core and the coil.

* * * * *